US009174832B2

(12) United States Patent
Shi et al.

(10) Patent No.: US 9,174,832 B2
(45) Date of Patent: Nov. 3, 2015

(54) CAPPING APPARATUS AND CAPPING SYSTEM FOR BOTTLE FILLING DEVICE

(75) Inventors: Zheng Shi, Zhejiang (CN); Yonglin Ji, Zhejiang (CN); Zhengfa Wang, Zhejiang (CN); Mingwei Hu, Zhejiang (CN)

(73) Assignee: HANGZHOU ZHONGYA MACHINERY CO., LTD., Hangzhou (CN)

( * ) Notice: Subject to any disclaimer, the term of this patent is extended or adjusted under 35 U.S.C. 154(b) by 772 days.

(21) Appl. No.: 13/395,285

(22) PCT Filed: Dec. 31, 2009

(86) PCT No.: PCT/CN2009/076385

§ 371 (c)(1), (2), (4) Date: Mar. 9, 2012

(87) PCT Pub. No.: WO2011/029260

PCT Pub. Date: Mar. 17, 2011

(65) Prior Publication Data

US 2012/0167526 A1 Jul. 5, 2012

(30) Foreign Application Priority Data

Sep. 10, 2009 (CN) ..... 2009 1 0102266

(51) Int. Cl.

*B67B 3/06* (2006.01)
*B67B 3/10* (2006.01)
*B67B 3/24* (2006.01)
(Continued)

(52) U.S. Cl.

CPC ..... *B67B 3/2053* (2013.01); *B67B 3/20* (2013.01); *B67B 3/264* (2013.01)

(58) Field of Classification Search

CPC ..... B67B 3/06; B67B 3/064; B67B 3/10; B67B 3/24

USPC ..... 53/281, 287, 299, 306, 310, 311, 312, 53/331

See application file for complete search history.

(56) References Cited

U.S. PATENT DOCUMENTS 1,392,980 A * 10/1921 Taylor ..... 53/304
1,994,736 A * 3/1935 Von Sydow et al. ..... 221/293
(Continued)

FOREIGN PATENT DOCUMENTS

CN 2719806 Y 8/2005
CN 101407310 A 4/2009
(Continued)

*Primary Examiner* — Andrew M Tecco
*Assistant Examiner* — Praachi M Pathak
(74) *Attorney, Agent, or Firm* — Birch, Stewart, Kolasch & Birch, LLP

(57) ABSTRACT

A capping apparatus for a bottle filling device with a capping head main body; a first slide body is located on the capping head main body and can slide up and down; a capping door mechanism is hinged with the capping head main body and the first slide body; a cap sucking head can slide up and down; a middle slide body is arranged between the cap sucking head and the first slide body and can slide up and down; a first spring and a second spring; and a cap inlet chute. A capping system is equipped with a plurality of capping apparatus, the number of the capping apparatus is equal to that of columns of filled bottles, and the cap sucking heads of the capping apparatus are connected together through a connection structure with a mechanism that actuates the cap sucking heads to rise up and fall down.

19 Claims, 3 Drawing Sheets

(51) Int. Cl.
*B67B 3/20* (2006.01)
*B67B 3/26* (2006.01)

(56) References Cited

U.S. PATENT DOCUMENTS 2,015,913 A * 10/1935 Von Sydow et al. ..... 221/293
3,628,307 A * 12/1971 Croasdale et al. ..... 53/299
3,683,588 A * 8/1972 Ahlers ..... 53/64
5,115,617 A * 5/1992 Lewis et al. ..... 53/306
5,996,308 A 12/1999 Nakamura
6,115,992 A * 9/2000 Bankuty et al. ..... 53/308
2007/0006550 A1 * 1/2007 Kemper et al. ..... 53/426

FOREIGN PATENT DOCUMENTS

CN 201305441 Y 9/2009
DE 199 46 951 A1 4/2001
JP 8-113291 A 5/1996
JP 10-329894 A 12/1998

* cited by examiner

CAPPING APPARATUS AND CAPPING SYSTEM FOR BOTTLE FILLING DEVICE

CROSS-REFERENCE TO RELATED APPLICATIONS

The present application claims priority under 35 USC 119 to PCT Patent Application No. PCT/CN2009/076385 filed on Dec. 31, 2009, and Chinese Patent Application No. 200910102266.6 filed Sep. 10, 2009, the contents of which are hereby incorporated by reference.

FIELD OF INVENTION

The present invention relates to a capping apparatus for a linear type bottle filling device.

BACKGROUND OF THE INVENTION

For the purpose of higher production efficiency of linear type bottle filling device used to fill milk and milk beverages, bottles are normally arranged in a line, where filling, capping and cap tightening are conducted simultaneously. In this case, plastic caps after arrangement are required to be secondarily distributed to their corresponding slideways in an even manner. After being sterilized, the plastic caps are precisely put on bottle openings subject to the predetermined requirements in order to facilitate the following tightening process. Conventionally, bottle caps are branched in the manner that the number of passageways increases geometrically, in other words, one passageway branches into two passageways, two into four, four into eight and the like. The capping is achieved by a power-free cap grabbing, more specifically, the bottle caps sliding off the preset slideways are blocked by two leaf springs at the front end of a grabbing head when the bottle caps are in an inclined state. As the front edge of a bottle cap is lower than the level of the bottle opening while the rear edge is higher than said level, when the bottles horizontally pass through the cap grabbing head, the bottle openings grab the front edges of the bottle caps, which are then carried away and fall on the bottle openings, during which the leaf springs block the following cap.

The aforesaid solution has the disadvantages that:

1. As the cap passageways increase geometrically, this will bring about huge-sized passageways in case of a great number of bottles are in the line;

2. The bottle caps are not blocked when passing through a sterilizing chamber, therefore the bottle caps are arranged all over the cap slideways. It is no problem for sterilization during normal working process but unfavorable at the beginning of process of filling and capping the bottles. When the bottle caps pass though the cap slideways rapidly due to less bottle caps distributed therein, consequently, the sterilizing is incomplete, the hygienic quality of the final products will be affected;

3. When grabbing is used for capping, if the bottle caps fail to precisely fit with the bottle openings, the bottle caps would not be covered properly. It will affect the following tightening effects. Furthermore, the grabbing head is disposed with the leaf springs for plastic caps, it is sometimes unreliable that the following cap may be carried over together with the previous one.

SUMMARY OF THE INVENTION

In view of the abovementioned problems, it is one object of the invention to overcome the drawbacks of the prior art by providing a reliable capping apparatus for a bottle filling device. To achieve the aforesaid object, the adopted technical solution is described below: a reliable capping apparatus for a bottle filling device, in accordance with the present invention, comprises a capping head main body, a first slide body which is slidable up and down the capping head main body, and a capping door mechanism, which is hinged with the capping head main body and the first slide body.

Said capping apparatus also includes a cap sucking head, which is slidable up and down and which is connected to a mechanism driving the cap sucking head to move up and down. The cap sucking head can move downwards to apply bottle caps onto containers via the capping head main body.

Between the cap sucking head and the first slide body is disposed with a middle slide body capable of sliding up and down, the middle slide body moves downwards to act on the first slide body to drive it to move downwards. A spare distance is disposed at the upper and lower directions of the middle slide body and the first slide body, so that the middle slide body will not act on the first slide body while moving downwards at the initial stage.

The capping apparatus is also disposed with a second spring and a first spring, in which the second spring is compressed to act on the middle slide body along with the downward movement with the cap sucking head. The first spring is located between the capping head main body and the first slide body and supports the first slide body.

The capping apparatus is also provided with cap inlet chutes.

It is another object of the invention to provide a reliable capping system which is applied for the bottle filling device. To achieve this object, the adopted technical solution is described below: a capping system, in accordance with the present invention, comprises a plurality of capping apparatus whose number equals to the lines of bottle, wherein the capping apparatus are the ones described above, the cap sucking heads of the capping apparatus are connected together via a connecting structure and then connected to the mechanism which drives said cap sucking heads to move up and down.

When the technical solutions provided herein are adopted, the capping motion can be stably, reliably and precisely achieved, thus the working quality of the linear type bottle filling device is improved.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE EMBODIMENTS

Figure 2:
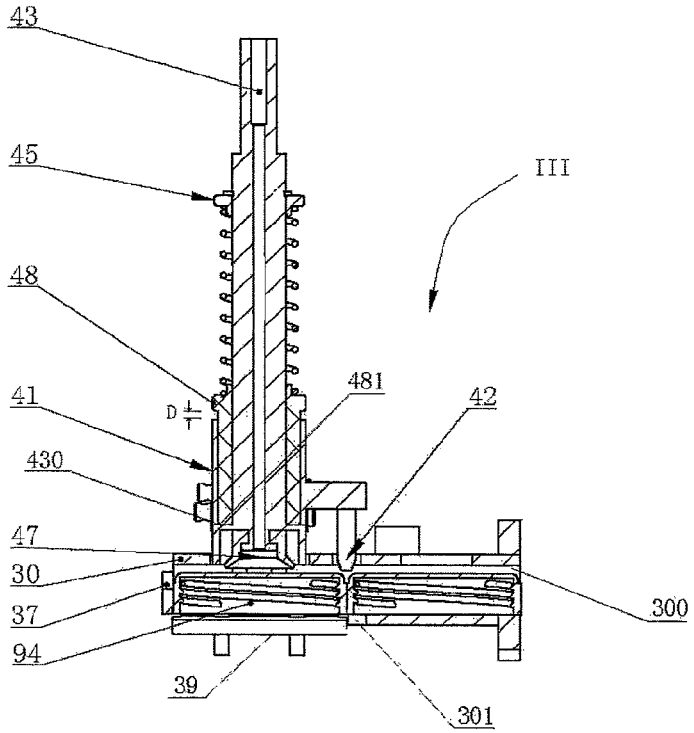
FIG. 2 is a sectional view of the capping apparatus for the bottle filling device in accordance with the example of FIG. 1 taken from the line A-A.
Figure 1:
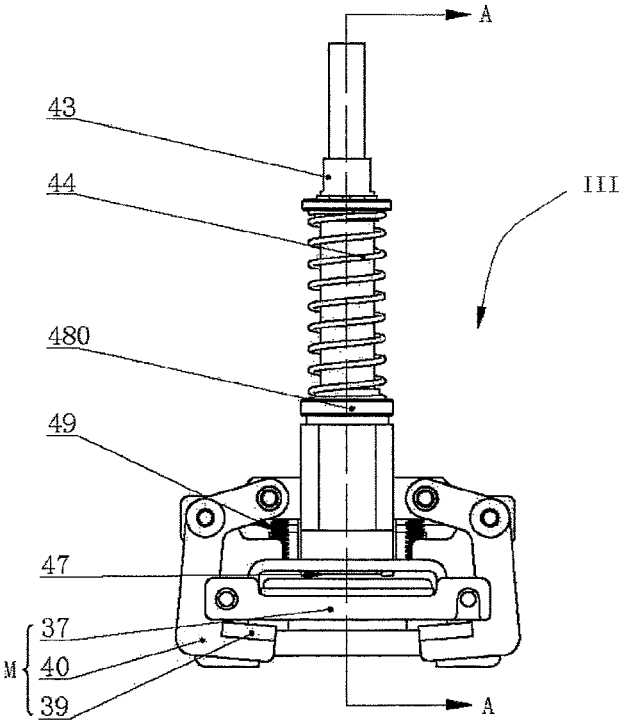
FIG. 1 is a schematic diagram of a capping apparatus for a bottle filling device with cap sucking heads rising at the top point in accordance with an example of the present invention.

As shown in FIGS. 1 and 2, a capping apparatus III for a bottle filling device, in accordance with the present invention, comprises a capping head main body 30, a first slide body 41 which is slidable up and down the capping head main body 30, and a swingable capping door mechanism M, which is composed of a door structure 39 with a movable door 37 and a connecting rod 40. The door structure 39 is a cap pallet for a capping orifice 301 on the capping head main body 30. After the door structure 39 is closed, a cap 94 to be covered slides onto the cap pallet. The connecting rod 40 is hinged with the capping head main body 30 and the first slide body 41.

The capping apparatus includes a cylindrically-shaped cap sucking head 43 which is slidable up and down. of the cap sucking head 43 is a vacuum sucking disc 47 and the middle portion along the length of the cap sucking head 43 is provided with air passages. The cap sucking head 43 is connected with a mechanism M which drives it to move up and down. When the cap sucking head 43 moves downwards, it puts a cap 94 on a container via the capping head main body 30.

A middle slide body 48 is provided between the cap sucking head 43 and the first slide body 41, and the middle slide body 48 can move downwards to act on the first slide body 41 *e* causing the first slide body 41 to move downwards. A spare distance D is provided at the upper and lower directions of the middle slide body 48 and the first slide body 41, so that the middle slide body 48 will not act on the first slide body 41 while moving downwards at an initial stage of operation of the capping apparatus III.

The first slide body 41 has a slide sleeve on an internal cylindrical surface thereof extending from top and bottom, and the middle slide body 48 is arranged in the slide sleeve of the first slide body 41. The middle slide body 48 also has a slide sleeve on an internal cylindrical surface thereof extending from top to bottom, and the cap sucking head 43 is disposed in the slide sleeve of the middle slide body 48.

A second compression spring 44 is arranged between a supporting ring 45 formed on an upper portion of the cap sucking head 43 and a raised edge 480 on a upper-most portion of the middle slide body 48. The second spring 44 is compressed to act on the raised edge 480 on an uppermost part of the middle slide body 48 along with the downward movement of the cap sucking head 43. A first compression spring 49 is arranged between the first slide body 41 and the capping head main body 30 and supports the first slide body 41.

The capping apparatus III is provided with cap inlet chutes 300, and one section of each of said cap inlet chutes 300 is disposed within said capping head main body 30.

The spare distance D equals to a movement distance that the cap sucking head 43 travels to suck up caps 94. Therefore, when the cap sucking head 43 driven by the driving mechanism moves downwards to suck up the caps 94, the middle slide body 48 can act on the first slide body 41 to drive it to move downwards to open the door structure 39 of the capping door mechanism M. In this way, the cap sucking head 43 continuously moves downwards to carry out the capping process, thus the capping is in a highly efficient manner.

The cap sucking head 43 has a step surface 430 that can raise the middle slide body 48 and the first slide body 41 when the cap sucking head 43 moves upwards. The middle slide body 48 has a lower end portion 481 which is raised by said structure earlier than the first slide body 41. When the raised edge 480 on the uppermost part of the middle slide body 48 acts on the upper end of the first slide body 41, the first slide body 41 begins to move downwards, then the capping door mechanism M gradually opens up along with the downward movement of the first slide body 41 until the first slide body 41 is blocked by a stopper on the capping head main body 30. At this point, the movable door 37 of the door structure 39 opens to the maximum degree and the cap sucking head 43 keeps moving downwards, but each of the first slide body 41 and the middle slide body 48 stop going down. When the lower end of the cap sucking head 43 descends via the capping orifice 301 on the capping head main body 30 until the cap 94 is put on the bottle opening, the vacuum sucking disc 47 releases the cap 94, and the cap sucking head 43 driven by the driving mechanism rises back to its original position. The step surface 430 at the lowermost end of the cap sucking device 43 firstly contacts with the lower end portion 481 of the middle slide portion 48 to drive the middle slide body 48 to rise. After the cap sucking head 43 rises by another distance equivalent to the spare distance D, the step surface 430 makes contact with a lowermost end of the first slide body 41, and drives both of the first slide body 41 and the middle slide body 48 to rise back to their original positions.

To facilitate orderly capping operations, said first slide body 41 is connected with a cap inlet door 42 which functions to block the cap inlet chute 300. The closing position of the cap inlet door 42 is not located at the central portion of the cap inlet chute 300. Therefore, the cap inlet door 42 can be closed by means of a clearance at the non-central portion formed between two adjacent caps, so that the cap inlet door 42 is closed without being affected by the caps. The capping head main body 30 is connected with a cap slideway 104 that enables caps to slide downwardly to the cap inlet door 42.

Figure 3:
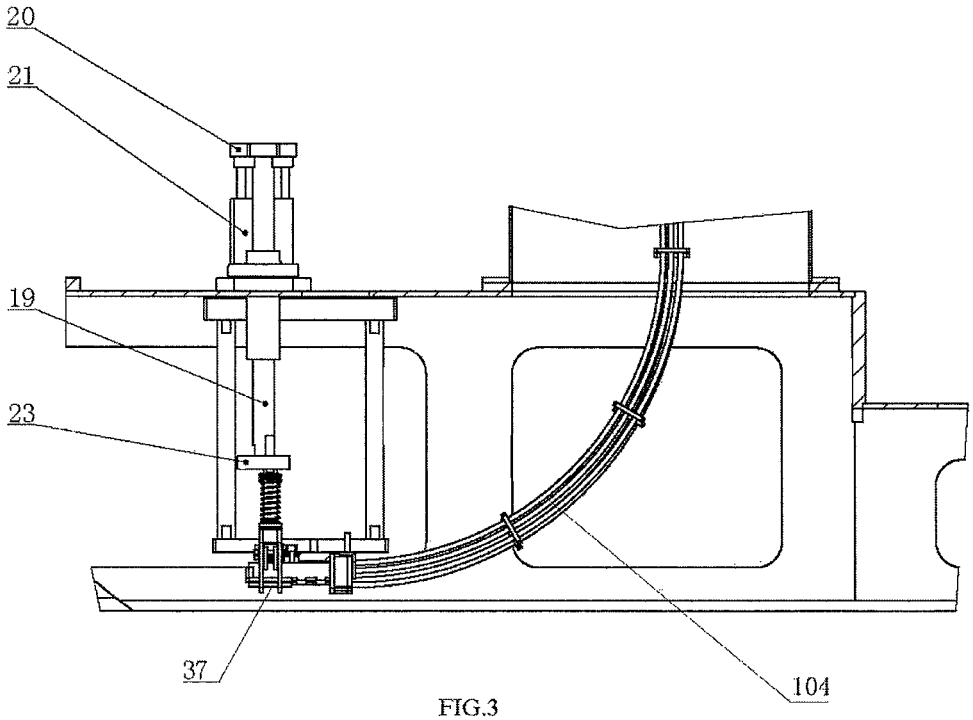
FIG. 3 is a schematic diagram of a capping system assembled from the capping apparatus in accordance with the example of FIG. 1 of the present invention.
Figure 4:
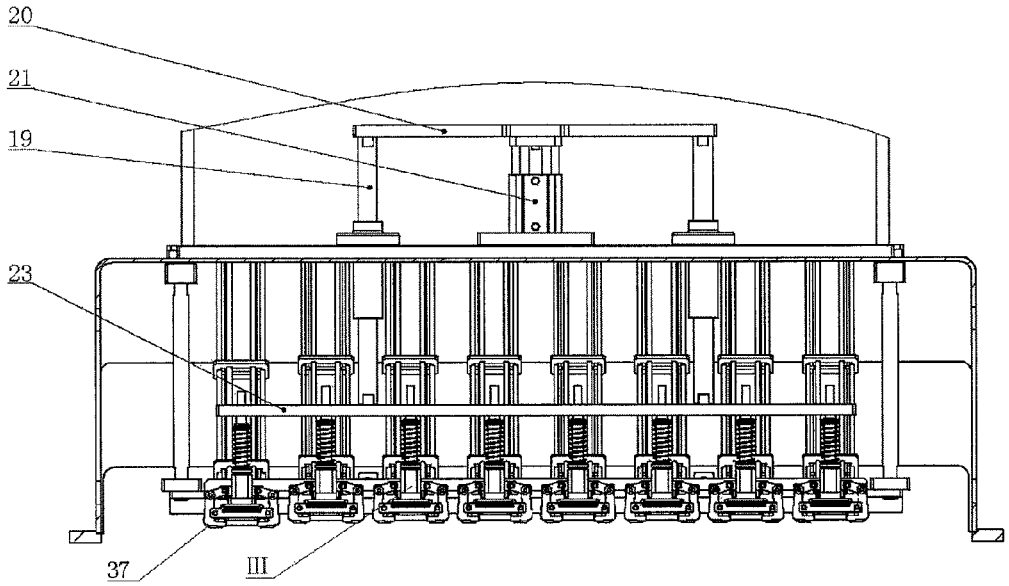
FIG. 4 is a left view of the capping system in accordance with the example of FIG. 3 of the present invention.

As shown in FIGS. 3-4, the capping head main body 30 has an open-mouthed front end that is provided with a movable door 37. Workers can take out the caps 94 within the capping head main body 30 during overhaul. When applied in the bottle filling device, capping apparatus III are arranged in rows and have a number equivalent to that of filled bottle lines. The cap sucking heads 43 of said capping apparatus III are connected together via a connecting plate 23 and then connected with a vertical guide rod 19, a cylinder connecting plate 20, and finally a cylinder 21, which drives the cap sucking heads 43 to move up and down.

The cap slideways 104 and the capping apparatus III are located within a sterilized chamber. The cap slideways 104 are arranged in a sterilizing chamber one by one, i.e.: adjacent to each other. The cap slideways 104 in the sterilizing chamber are also cap slideways 104 from top to bottom, having the same number as the capping apparatus III. The upper end of the cap slideways 104 in the sterilizing chamber are connected with cap distribution devices, which divide the caps 94 from cap arrangement devices into multiple lines whose number equals to that of the cap slideways 104 in the sterilizing chamber, and then the caps 94 are fed into the sterilizing chamber.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A capping apparatus for a bottle filling device, comprising:

a capping head main body 30, a first slide body 41 which is slidable up and down with respect to the capping head main body 30, and a capping door mechanism M, which includes a door structure 39, a connecting rod 40, and a movable door 37, is hinged with the capping head main body 30 and the first slide body 41;

a cap sucking head 43, which is slidable up and down and which is connected to a mechanism driving the cap sucking head 43 to move up and down, the cap sucking head 43 being adapted to move downwards to apply bottle caps 94 onto containers via the capping head main body 30;

a middle slide body 48 arranged in a radial direction between the cap sucking head 43 and the first slide body 41, the middle slide body 48 being capable of sliding up and down, and to move downwards to act on the first slide body 41 in order to drive the first slide body 41 to move downwards, a spare distance disposed at upper and lower directions of the middle slide body 48 and the first slide body 41, so that the middle slide body 48 will not be able to act on the first slide body 41 while moving downwards at an initial stage of a bottle capping process;

wherein the capping apparatus also includes a second spring 44 and a first spring 49, in which the second spring 44 is compressed to act on the middle slide body 48 along with the downward movement with the cap sucking head 43, and meanwhile, the first spring 49 is located between the capping head main body 30 and the first slide body 41, and supports the first slide body 41; and the capping apparatus is also provided with one or more cap inlet chutes 300, wherein a section of each of the inlet chutes 300 is located within the capping head main body 30.

2. The capping apparatus for bottle filling device according to claim 1, wherein a lower end of a cap slideway 104 is connected to the capping head main body 30.

3. The capping apparatus for bottle filling device according to claim 1, wherein the first spring 49 is located adjacent a lower end of the middle slide body 48 and the first slide body 41.

4. The capping apparatus for bottle filling device according to claim 1, wherein a lower end of a cap slideway 104 is connected to the capping head main body 30.

5. The capping apparatus for bottle filling device according to claim 1, wherein the spare distance is equal to a movement distance that the cap sucking head 43 travels downwards in order to suck up the caps 94 during the bottle capping process.

6. The capping apparatus for bottle filling device according to claim 1, wherein the first slide body 41 includes a slide sleeve on an internal cylindrical surface thereof extending from top to bottom of the first slide body 41, the middle slide body 48 is arranged in the slide sleeve of the first slide body 41, and the cap sucking head 43 is disposed in the slide sleeve of the first slide body 41.

7. The capping apparatus for bottle filling device according to claim 6, wherein the capping head main body 30 has an open-mouthed front end that is disposed with the movable door 37.

8. The capping apparatus for bottle filling device according to claim 6, wherein the capping head main body 30 includes a capping orifice 301, and the door structure 39 of the capping door mechanism M is a cap pallet adjacent to the capping orifice 301.

9. The capping apparatus for bottle filling device according to claim 6, wherein the first slide body 41 is connected with a cap inlet door 42 which functions to block the cap inlet chutes 300, and a closing position of the cap inlet door 42 is located away from a central portion of the cap inlet chutes 300.

10. The capping apparatus for bottle filling device according to claim 6, wherein the cap sucking head 43 has a step surface 430 at a lowermost end thereof that is able to raise the middle slide body 48 and the first slide body 41 when the cap sucking head 43 moves upwards, and the middle slide body 48 has a lower end portion 481 which is raised by the step surface 430 before the first slide body 41 is raised during the bottle capping process.

11. The capping apparatus for bottle filling device according to claim 1, wherein the cap sucking head 43 has a step surface 430 at a lowermost end thereof that is able raise the middle slide body 48 and the first slide body 44 when the cap sucking head 43 moves upwards, and the middle slide body 48 has a lower end portion 481 which is raised by the step surface 430 before the first slide body 41 is raised during the bottle capping process.

12. The capping apparatus for bottle filling device according to claim 1, wherein the first slide body 41 is connected with a cap inlet door 42 which functions to block the cap inlet chutes 300, and a closing position of the cap inlet door 42 is located away from a central portion of the cap inlet chutes 300.

13. The capping apparatus for bottle filling device according to claim 1, wherein the capping head main body 30 includes a capping orifice 301, and the door structure 39 of said capping door mechanism M is a cap pallet adjacent to the capping orifice 301.

14. The capping apparatus for bottle filling device according to claim 1, wherein the capping head main body 30 has an open-mouthed front end that is provided with the movable door 37.

15. The capping apparatus for bottle filling device according to claim 1, wherein the capping apparatus is part of a capping system that includes multiple capping apparatuses equal to a number of rows of bottles, the cap sucking heads 43 of each of the capping apparatuses are connected together via a connecting plate and then are connected to the capping door mechanism M of the system which drives the cap sucking heads 43 to move up and down.

16. The capping apparatus for bottle filling device according to claim 1, wherein the middle slide body 48 has a length that is longer than a length of the first slide body 41.

17. The capping apparatus for bottle filling device according to claim 1, wherein the door structure 39 includes upper members attached to the apparatus at locations adjacent to an outer side of the first slide body 41, and lower members extending under the movable door 37.

18. A capping apparatus for a bottle filling device, comprising:

a capping head main body 30, a first slide body 41 which is slidable up and down with respect to the capping head main body 30, and a capping door mechanism M, which includes a door structure 39, a connecting rod 40, and a movable door 37, is hinged with the capping head main body 30 and the first slide body 41;

a cap sucking head 43, which is slidable up and down and which is connected to a mechanism driving the cap sucking head 43 to move up and down, the cap sucking head 43 being adapted to move downwards to apply bottle caps 94 onto containers via the capping head main body 30;

a middle slide body 48 arranged in a radial direction between the cap sucking head 43 and the first slide body 41, the middle slide body 48 being capable of sliding up and down, and to move downwards to act on the first slide body 41 in order to drive the first slide body 41 to move downwards, a spare distance disposed at upper and lower directions of the middle slide body 48 and the first slide body 41, so that the middle slide body 48 will not be able to act on the first slide body 41 while moving downwards at an initial stage of a bottle capping process;

wherein the capping apparatus also includes a second spring 44 and a first spring 49, in which the second spring 44 is compressed to act on the middle slide body 48 along with the downward movement with the cap sucking head 43, and meanwhile, the first spring 49 is located between the capping head main body 30 and the first slide body 41, and supports the first slide body 41; and the capping apparatus is also provided with one or more cap inlet chutes 300, wherein a lower end of a cap slideway 104 is connected to the capping head main body 30.

19. A capping apparatus for a bottle filling device, comprising:

a capping head main body 30, a first slide body 41 which is slidable up and down with respect to the capping head main body 30, and a capping door mechanism M, which includes a door structure 39, a connecting rod 40, and a movable door 37, is hinged with the capping head main body 30 and the first slide body 41;

a cap sucking head 43, which is slidable up and down and which is connected to a mechanism driving the cap sucking head 43 to move up and down, the cap sucking head 43 being adapted to move downwards to apply bottle caps 94 onto containers via the capping head main body 30;

a middle slide body 48 arranged in a radial direction between the cap sucking head 43 and the first slide body 41, the middle slide body 48 being capable of sliding up and down, and to move downwards to act on the first slide body 41 in order to drive the first slide body 41 to move downwards, a spare distance disposed at upper and lower directions of the middle slide body 48 and the first slide body 41, so that the middle slide body 48 will not be able to act on the first slide body 41 while moving downwards at an initial stage of a bottle capping process;

wherein the capping apparatus also includes a second spring 44 and a first spring 49, in which the second spring 44 is compressed to act on the middle slide body 48 along with the downward movement with the cap sucking head 43, and meanwhile, the first spring 49 is located between the capping head main body 30 and the first slide body 41, and supports the first slide body 41; and the capping apparatus is also provided with one or more cap inlet chutes 300, wherein the cap sucking head 43 has a step surface 430 at a lowermost end thereof that is able raise the middle slide body 48 and the first slide body 44 when the cap sucking head 43 moves upwards, and the middle slide body 48 has a lower end portion 481 which is raised by the step surface 430 before the first slide body 41 is raised during the bottle capping process.

* * * * *